US006779455B2

(12) United States Patent
Figov et al.

(10) Patent No.: US 6,779,455 B2
(45) Date of Patent: Aug. 24, 2004

(54) METHOD OF PRINTING VARIABLE INFORMATION

(75) Inventors: Murray Figov, Raanana (IL); Anna Sigalov, Netanya (IL)

(73) Assignee: Creo Il Ltd., Herzlia Pituach (IL)

( * ) Notice: Subject to any disclaimer, the term of this patent is extended or adjusted under 35 U.S.C. 154(b) by 0 days.

(21) Appl. No.: 10/381,676

(22) PCT Filed: Aug. 12, 2001

(86) PCT No.: PCT/IL01/00742

§ 371 (c)(1),
(2), (4) Date: Mar. 27, 2003

(87) PCT Pub. No.: WO02/26497

PCT Pub. Date: Apr. 4, 2002

(65) Prior Publication Data

US 2004/0011234 A1 Jan. 22, 2004

Related U.S. Application Data

(60) Provisional application No. 60/235,918, filed on Sep. 28, 2000.

(51) Int. Cl.[7] ..... B41L 19/00

(52) U.S. Cl. ..... 101/489; 101/175; 101/177; 101/211; 101/DIG. 29; 204/483; 204/487; 204/488; 204/508; 347/55

(58) Field of Search ..... 101/175, 177, 101/211, 489, DIG. 29; 204/483, 488, 487, 508; 347/55

(56) References Cited

U.S. PATENT DOCUMENTS 4,881,084 A 11/1989 Kan et al.
5,538,601 A * 7/1996 Castegnier ..... 204/486
5,727,462 A 3/1998 Castegnier
5,908,541 A * 6/1999 Castegnier ..... 204/486
6,006,061 A * 12/1999 Liu et al. ..... 399/296
6,219,501 B1 * 4/2001 Zhao et al. ..... 399/57
6,231,720 B1 * 5/2001 Mouri et al. ..... 162/135
6,386,683 B1 * 5/2002 Muroi et al. ..... 347/55
6,482,571 B1 * 11/2002 Teng ..... 430/302
6,536,876 B1 * 3/2003 Fotland et al. ..... 347/55
2003/0066751 A1 * 4/2003 May et al.

OTHER PUBLICATIONS

Castegnier Adrien, Optimizing the Elcography Printing Cycle (IS&T's NIP13: 1997 International Conference on Digital Printing Technologies, p. 746).

* cited by examiner

*Primary Examiner*—Andrew H. Hirshfeld
*Assistant Examiner*—Kevin D. Williams
(74) *Attorney, Agent, or Firm*—Edward Langer, Pat. Atty.; Shiboleth, Yisraeli, Roberts, Zisman & Co.

(57) ABSTRACT

The gel method of printing variable information of the present invention involves applying inks onto a substrate that is part of or attached to a cylinder of the printing machine. Imaging is by means of an energy source in the UV, visible or infrared regions, modulated to represent a digital image pattern that has been composed on a computer. The consequence of imaging is to gel the ink and increase its adhesion to the substrate of the printing cylinder. The non-gelled background ink with lower adhesion is then removed by a squeegee action and returned to an ink reservoir. The remaining image is transferred to an offset blanket or directly to print stock by pressure. The process does not use a master, but produces an image that is erased after printing with each cylinder rotation so that the next rotation producing the next print can have fresh information written upon it.

19 Claims, 1 Drawing Sheet

METHOD OF PRINTING VARIABLE INFORMATION

This application claims benefit of Ser. No. 60/235,918, filed Sep. 28, 2000.

FIELD OF THE INVENTION

The present invention relates to a gel method of printing variable information, more particularly to a printing method involving a special ink, which is gelled by means of an energy source.

BACKGROUND TO THE INVENTION

In recent years, copying and printing technologies have begun to merge. Copying may be described as the ability to reproduce an original document one or more times. Printing may be described as creating a master that can be used to produce multiple impressions. Both processes create multiple copies of identical information.

For many years, copying has been dominated by electrophotography and more specifically xerography. An important means of printing that has been strongest in the market for printing impressions onto paper is offset lithography. Development and wide distribution of computers has enabled origination for printing to be prepared in an electronic form. While the need to copy documents is still widespread, documents can also be generated directly from computers using similar electrophotographic techniques as those that were originally developed for document copying. Similarly, printing plates can be produced directly from computers and used on offset lithographic machines for multiple impressions. These two types of processes have become opposite economic ends of the printing process, with electrophotographic printing being most economical for short runs and offset lithography being most economic for long runs. Each process has its own advantages and disadvantages. Although xerographic printing has a great complexity of technology, it has the ability to vary information from print to print, whereas offset has a fixed master.

Two of the big disadvantages of electro-photography are the need to use a toner and the limits of the speed of the process due to its complexity. The toner, which is particulate in structure, is relatively expensive to produce and has a limit to the minimum size of particles, which also affects quality of reproduction.

Electrocoagulation is a process described by Castegnier, in an article entitled "Optimizing the Electrography Printing Cycle (IS&T's NIP13: 1997 International Conference on Digital Printing Technologies, p.746). Imaging is accomplished by an array of electrodes which, when current flows, cause ink to coagulate and gel. As described in the article, the system adjustment is very critical. Also, current flows from electrode tips and it is difficult to direct it in an accurate manner, because it can flow from any point on the surface of the electrode, resulting in poor image quality.

Other processes such as ink jet are also being used for printing, aimed at providing fast variable printing. However, the ink jet process has difficulty printing good quality color work on a variety of printing stock. The present invention seeks to overcome these and other disadvantages.

It would be desirable to provide a printing method which uses an ink and not a toner, which is capable of producing variable information from print to print, which has simpler stages than those of electro-photography and which can be printed onto a large variety of printing stocks.

SUMMARY OF THE INVENTION

In accordance with a preferred embodiment of the present invention there is provided a method of printing on media, comprising the steps of:

applying a radiation sensitive ink to a surface of a cylinder;

radiating energy in an image pattern so as to create image and non-image areas, such that said ink in said image areas becomes gelled and said ink in said non-image areas does not gel;

wiping said non-gelled ink away from said surface of said cylinder; and transferring said gelled ink onto the media.

The method of the invention involves special inks that are applied onto a substrate that is part of or attached to a cylinder of the printing machine. Imaging is by means of an energy source in the UV, visible or infrared regions, modulated to represent a digital image pattern that has been composed on a computer.

The consequence of imaging is to gel the ink and increase its adhesion to the substrate of the printing cylinder. The non-gelled background ink with lower adhesion is then removed by a squeegee action and returned to an ink reservoir. The remaining image is transferred to an offset blanket or directly to print stock by pressure. The cycle may or may not continue with a brief cleaning of the cylinder surface before recoating for the next cycle and the next print. The ink that is transferred to the print stock can be further dried, either by the same type of radiation that resulted in gelation during imaging, or by another form of radiation.

It is possible to configure a machine in a similar manner to a laser printer in that all of the steps happen in one rotation of the drum of the machine. This means that all of the stages as described below will occur simultaneously. This would be done in order that the process be suitable for printing each print from its own digital file—i.e. variable information. Thus, the process does not use a master, but produces an image that is erased after printing with each cylinder rotation, so that the next rotation producing the next print can have fresh information written upon it.

BRIEF DESCRIPTION OF THE DRAWINGS

For a better understanding of the invention with regard to the embodiments thereof, reference is made to the accompanying drawing.

DETAILED DESCRIPTION OF A PREFERRED EMBODIMENT

Figure 1:
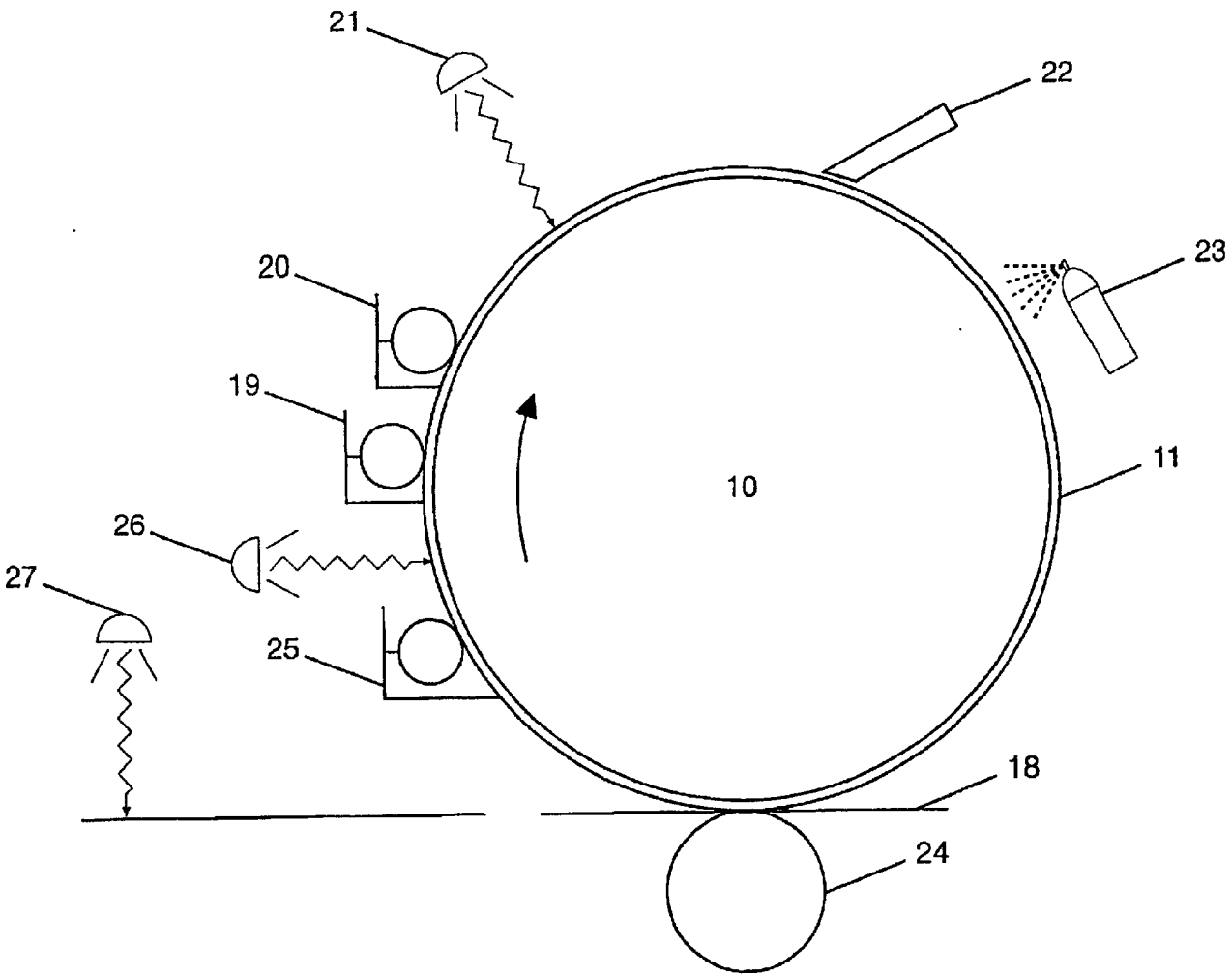
FIG. 1 is a diagrammatical representation of the printing cylinder for variable printing according to the method of the present invention.

Referring now to FIG. 1, there is shown a diagrammatical representation of printing cylinder 10, which is provided with surface 11. Surface 11 may be of aluminum or polyester or any other metal or plastic with a smooth surface that provides specific adhesion and release properties as described in the method. Optionally, applicator 19 can apply a very thin layer of release fluid such as silicone oil onto surface 11. Applicator 20 then applies a thin coat of radiation sensitive ink to the surface of the cylinder. Such a layer is approximately between 0.5 microns and 6 microns in thickness and covers the entire imaging area of surface 11. Applicators 19 and 20 can be any equipment known to the art of coating and could be for instance a spray or a wire wound rod or a series of rollers designed to produce a smooth and even film and to transfer it to cylinder surface 11. The film of ink is then subject to a radiation pattern that is representative of an original that may have been generated electronically on a computer. The radiation pattern may be of infrared radiation, such as produced by a YAG laser or laser diode, or it may be a visible light, such as produced by a Helium/Neon laser or SLM system, or a UV radiation, such as produced by a UV laser or SLM system, as described in PCT Patent Application Number WO00/69631 assigned to CreoScitex Corporation. The imaging head is represented in FIG. 1 as number 21.

The function of the radiation is to gel the ink to increase viscosity and adhesion to the substrate. The surface is then subject to squeegee blade 22 which may be a rubber blade resembling a wind-screen wiper. Non-reacted ink is squeegeed off and returned to the ink reservoir 20 to be re-used. In general, imaging processes for making plates involve reacting the coating to cure it completely; gelation is an intermediate stage in many reactions such as polymerization. One of the advantages of the method of the present invention is that much lower energies are required to gel material than to cure it completely.

Optionally, cylinder surface 11 may then be bathed in a bath of liquid that helps to loosen the imaged areas. The preferred liquid is water, which may have some additives or may be just distilled water. The water may be delivered to the surface by delivery device 23, which may function by any non-contact process—for instance spraying.

The remaining gelled ink, in the form of the image, is then transferred by pressure roller 24, either to an offset blanket (not shown) or to print stock 18. If an offset blanket is used, there is an additional step of transference. Surface 11 is then cleaned and dried by units 25 and 26, respectively, and is ready for the next cycle of imaging and printing.

Optionally, the print can be further fixed onto print stock 18 in unit 27, using either the same energy type which originally did the gelling, or another energy to which the ink is sensitive. This enables paper or even plastic stock to be used and instant ink drying to be obtained. The fixing process that may convert the gelled ink to a more polymerized hard film on the stock, provides a means of bonding the ink to the print stock, thus resulting in fast ink drying and great versatility of stock substrate. Plastics as well as paper can be printed on without problems of drying and adhesion and without the need for such devices as powder spray, as are used in conventional offset lithographic printing.

It is preferable that all of the stages function simultaneously during one cylinder cycle so that the print is obtained in a minimum time. Thus, laser imaging could be similar to the imaging system used in electrophotographic laser printers.

The method can be used for printing in process colors, by either mounting all colors around one printing cylinder or by passing the print stock under printing towers as is well known in offset lithography.

The nature of the ink depends on the nature of the source of imaging radiation, but the ink should contain colorant and have sensitivity to the radiation such that it forms a gel on exposure. Surface 11 may also have some sensitivity to the radiation, either in its ability to reflect or in its ability to absorb the radiation if it is infrared, so that the surface becomes sufficiently hot to transfer thermal energy back to the ink.

As the radiation need only gel the ink and not convert it into a hard resinous material with good adhesion to the substrate (as is needed in, by way of example, plate-making processes), the energy needed may be significantly lower. Moreover, the technology lends itself to a variety of imaging methods. For instance, the ink may be a polymeric emulsion containing a relatively volatile plasticizer. This would be provided in sufficient quantity to produce a semi-liquid film after the emulsion has been coated and the water driven off. If this emulsion contains an infrared absorber, or surface 11 contains the absorber, the imaging process can be effected merely by driving off the plasticizer in the image areas, leaving just sufficient plasticizer for the polymer to be in a gelled form. The semi liquid plasticized ink can be squeegeed off and the gelled ink transferred to print stock, where further heating will set it.

Alternatively, the ink can be a water-born polymer in the form of a highly viscous liquid. When the water is driven off by the infra-red imaging process, the imaged area changes into gel form.

EXAMPLES

The following descriptions are by way of example to illustrate the method as described.

Example I

The following ink was formulated (The formulation is by percentage parts in weight):

| | |
|---|---|
| Sartomer 368 (Cray Valley, Paris La Defense, France) | 42.96 |
| Craynor 435 (Cray Valley, Paris La Defense, France) | 25.67 |
| Sartomer 494 (Cray Valley, Paris La Defense, France) | 4.52 |
| ITX (Lambson, Castleford, West Yorkshire, England) | 2.54 |
| Irgacure 369 (CIBA-Geigy Corp., CH-4002, Basel, Switzerland) | 2.81 |
| Irgacure 907 (CIBA-Geigy Corp., CH-4002, Basel, Switzerland) | 3.07 |
| KTO-46 (Lamberti spa, Centro Direzionale "Le Torri", Via Marsala, VA, Italy) | 2.91 |
| Rose Bengal | 1.66 |
| Byk 307 (BYK-Gardner GmbH, Geretsried, Germany) | 1.4 |
| Craynor 501 (Cray Valley, Paris La Defense, France) | 12.46 |

A piece of uncoated aluminum was first cleaned with sodium silicate and then with methyl ethyl ketone. It was coated with a 4 micron thick layer of the above ink, using a wire wound rod. A flash exposure was made using UV light with an energy density of 150 microjoules per square centimeter. The coating was squeegeed with a rubber blade, removing non-imaged material. The coated aluminum was dipped, coating side down, into distilled water and then placed image side down on a piece of paper. A metal roller was rolled over the backside of the aluminum and the aluminum removed, leaving on the paper a sharp red image with no background. There was no material remaining on the aluminum. The image was cured by exposing to UV.

Example II

The following composition (Mixture 1) was mixed and ball milled for 24 hours (all parts by weight):

| | |
|---|---|
| Mogul L carbon black (Cabot Corporation, Billerca, MA, USA) | 7.7 |
| SMD 30207 Resin (Schenectady International Ltd., Schenectady, NY, USA) | 5.0 |

-continued

| | |
|---|---|
| Butyl Acetate | 65.4 |
| This mixture was ball milled and then the following mixture made from it: | |
| Mixture 1 | 35.3 |
| Dynomin UB 26BX (Dyno-Cytec, Botleweg 175, 3197 KA Rotterdam, Netherlands) | 19.5 |

Before coating onto 175 micron polyester, 3.9 grams of Cycat 4040 (Dyno-Cytec, Botleweg 175, 3197 KA Rotterdam, Netherlands) were added. The mixture was coated with a wire wound rod to a dry weight of 10 grams per square meter and then cured in the oven for 5 minutes at 140° C.

This material provided an example of surface 11. The surface was then treated, by rubbing silicone oil into it, using a soft piece of material. The following mixture was then made up:

| | |
|---|---|
| Cymel 373 (Dyno-Cytec, Botleweg 175, 3197 KA Rotterdam, Netherlands) | 100 parts |
| Cycat 4045 (Dyno-Cytec, Botleweg 175, 3197 KA Rotterdam, Netherlands) | 10 parts |
| Methylene blue | 1 part |

This mixture was coated with a rod to a weight of 4 grams per square meter, onto the surface prepared and described above. It was then exposed using a Lotem infrared plate setter using an exposure equivalent to approximately 5 millijoules per square centimeter. This energy was sufficient to gel the mixture by heat transference from the black layer described above. The non-imaged material was squeegeed off with a rubber blade and the resulting image transferred by pressing against paper.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

What is claimed is:

1. A method of printing on media, comprising the steps of:

applying a radiation-sensitive ink to a surface of a cylinder;

radiating said ink with energy in an image pattern, so as to create image and non-image areas, such that said ink in said image areas becomes gelled and said ink in said non-image areas does not gel;

wiping said non-gelled ink away from said surface of said cylinder; and transferring said gelled ink onto the media.

2. The method of claim 1 wherein said step of applying applies a layer of ink which is approximately between 0.5 and 6 microns in thickness.

3. The method of claim 1 wherein said step of applying is performed by at least one of the group of: a spray, a wire wound rod, and a series of rollers.

4. The method of claim 1 wherein said step of radiating is performed by at least one of an infrared radiation laser, a visible light laser and a UV laser.

5. The method of claim 4 wherein said infrared radiation is provided by at least one of a YAG laser and a laser diode.

6. The method of claim 4 wherein said visible light laser is provided by at least one of a Helium/Neon laser and an SLM system.

7. The method of claim 4 wherein said UV radiation is provided by at least one of a UV laser and an SLM system.

8. The method of claim 1 further comprising the step of bathing said cylinder surface in a liquid bath so as to loosen the imaged areas after said wiping step.

9. The method of claim 8 wherein said liquid bath is comprised of water.

10. The method of claim 8 wherein said step of bathing is performed by a non-contact process.

11. The method of claim 10 wherein said non-contact process comprises spraying.

12. The method of claim 1 wherein said step of transferring is performed by a pressure roller.

13. The method of claim 1 wherein said media is provided as an offset blanket.

14. The method of claim 1 further comprising the steps of:

cleaning said cylinder surface; and drying said cylinder surface, such that said cylinder surface is readied for a next cycle of imaging and printing.

15. The method of claim 14 in which all of said steps function simultaneously during one cylinder cycle.

16. The method of claim 1 wherein said ink further comprises colorant.

17. The method of claim 1 wherein said ink further comprises a polymeric emulsion comprising a volatile plasticizer.

18. The method of claim 1 wherein said ink further comprises a water-borne polymer in a highly viscous form.

19. The method of claim 1 wherein said ink is affixed to the media by at least one form of radiation.

* * * * *